US005688149A

United States Patent [19]

Aihara

[11] Patent Number: 5,688,149

[45] Date of Patent: Nov. 18, 1997

[54] ELECTRICAL TERMINAL AND CONNECTOR WITH IMPROVED RETENTION MEANS

[75] Inventor: Shinichi Aihara, Ebina, Japan

[73] Assignee: Molex Incorporated, Lisle, Ill.

[21] Appl. No.: 615,907

[22] Filed: Mar. 14, 1996

[30] Foreign Application Priority Data

Mar. 30, 1995 [JP] Japan ..... 7-097718

[51] Int. Cl.[6] ..... H01R 13/40

[52] U.S. Cl. ..... 439/733.1; 439/862

[58] Field of Search ..... 439/444, 733.1, 439/862, 636

[56] References Cited

U.S. PATENT DOCUMENTS

| | | | |
|---|---|---|---|
| 4,168,879 | 9/1979 | Ohtsuki et al. | 339/258 P |
| 4,385,795 | 5/1983 | Endoh et al. | 339/176 MF |
| 5,362,256 | 11/1994 | Hashiguchi | 439/733.1 |
| 5,433,616 | 7/1995 | Walden | 439/62 |

FOREIGN PATENT DOCUMENTS

| | | | |
|---|---|---|---|
| 0 131 118 B1 | 1/1987 | European Pat. Off. | H01R 23/68 |
| 2 018 051 | 3/1979 | United Kingdom | H01R 13/00 |

*Primary Examiner*—Khiem Nguyen
*Assistant Examiner*—Eugene G. Byrd
*Attorney, Agent, or Firm*—Stephen Z. Weiss

[57] ABSTRACT

An electrical terminal includes an elongated planar body portion defining generally parallel opposite sides and opposite edges. A contact portion extends forwardly of the body portion, and a terminating portion extends rearwardly of the body portion. The body portion includes a retention section having a retention nib coined out of each edge of the body portion, with each retention nib defining a generally planar surface offset from one side of the body portion and generally parallel thereto. The planar surfaces of the retention nibs are adapted for engaging one side of a passage in a connector housing, as the opposite side of the body portion engages the opposite side of the passage.

14 Claims, 6 Drawing Sheets

ELECTRICAL TERMINAL AND CONNECTOR WITH IMPROVED RETENTION MEANS

FIELD OF THE INVENTION

This invention generally relates to the art of electrical connectors and, particularly, to an improved retention means or system for holding the terminals in the connector housing.

BACKGROUND OF THE INVENTION

A known type of input/output electrical connector includes a dielectric housing having a front mating face and a rear face with a terminal-receiving cavity means or a plurality of terminal-receiving passages extending between the faces. A plurality of terminals are mounted in the housing, with forwardly extending mating or contact portions of the terminals provided for mating with the terminals of a complementary mating connector. The terminals have rearwardly extending terminating portions, such as tail portions projecting from the connector housing. Most often, the terminals have enlarged body portions between the mating and terminating portions and which are used to fix the terminals within the passages in the housing to maintain the terminals in proper spacing and alignment. The terminals typically are stamped and formed of conductive sheet metal material.

Heretofore, the enlarged body portions of the terminals have included retention sections. Typically, a retention section is formed with teeth projecting laterally outwardly from opposite edges of the terminal to skive into the sides of a respective terminal-receiving passage in the connector housing. Other types of terminal retention means have included raised sections of the terminal centered generally on the longitudinal axis of the terminal. Often, the side teeth or the center raised sections have been inadequate in preventing movement of the terminal within its respective terminal-receiving passage.

The present invention is directed to solving the above problems and satisfying the need for an effective retention system for holding terminals within passages in electrical connector housings.

SUMMARY OF THE INVENTION

An object, therefore, of the invention is to provide a new and improved retention system or means for terminals within electrical connector housings.

In the exemplary embodiment of the invention, an electrical terminal includes an elongated planar body portion defining generally parallel opposite sides and opposite edges. A contact portion extends forwardly of the body portion, and a terminating portion extends rearwardly of the body portion. The body portion includes a retention section having a retention nib coined out of each edge of the body portion and defining a generally planar surface offset from one side of the body portion and generally parallel thereto.

With the above structural combination, the planar surfaces of the retention nibs are adapted for engaging one side of a passage in an appropriate electrical connector housing. The opposite side of the body portion engages the opposite side of the passage.

As disclosed herein, the terminal is stamped and formed of sheet metal material. Each of the retention nibs includes a tooth projecting outwardly of the adjacent edge of the body portion for establishing an interference fit with a portion of the passage. The retention nibs are spaced laterally of the body portion to leave a planar section of the body portion between the nibs.

Another feature of the invention comprises teeth projecting outwardly from the opposite edges of the body portion and spaced longitudinally of the retention section. The teeth are located between the retention section and the contact portion of the terminal.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
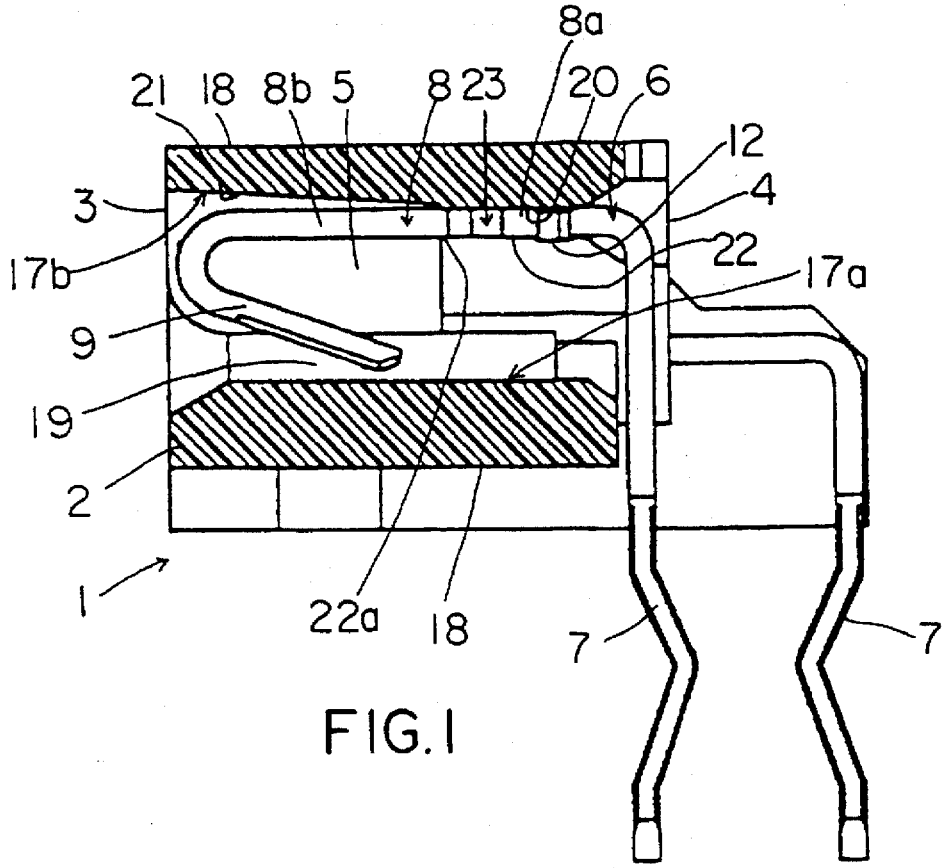
FIG. 1 is an enlarged section taken generally along line A—A of FIG. 3.

Referring to the drawings in greater detail, and first to FIGS. 1–5, the invention is embodied in an electrical connector, generally designated 1, having a housing 2 unitarily molded of dielectric material such as plastic or the like. The housing includes a front mating face 3 and a rear terminating face 4. A plurality of terminal-receiving passages 5 extend in a direction between the faces. A plurality of terminals, generally designated 6, are stamped and formed of sheet metal material and are inserted through the rear face of the housing into the passages.

Figure 6:
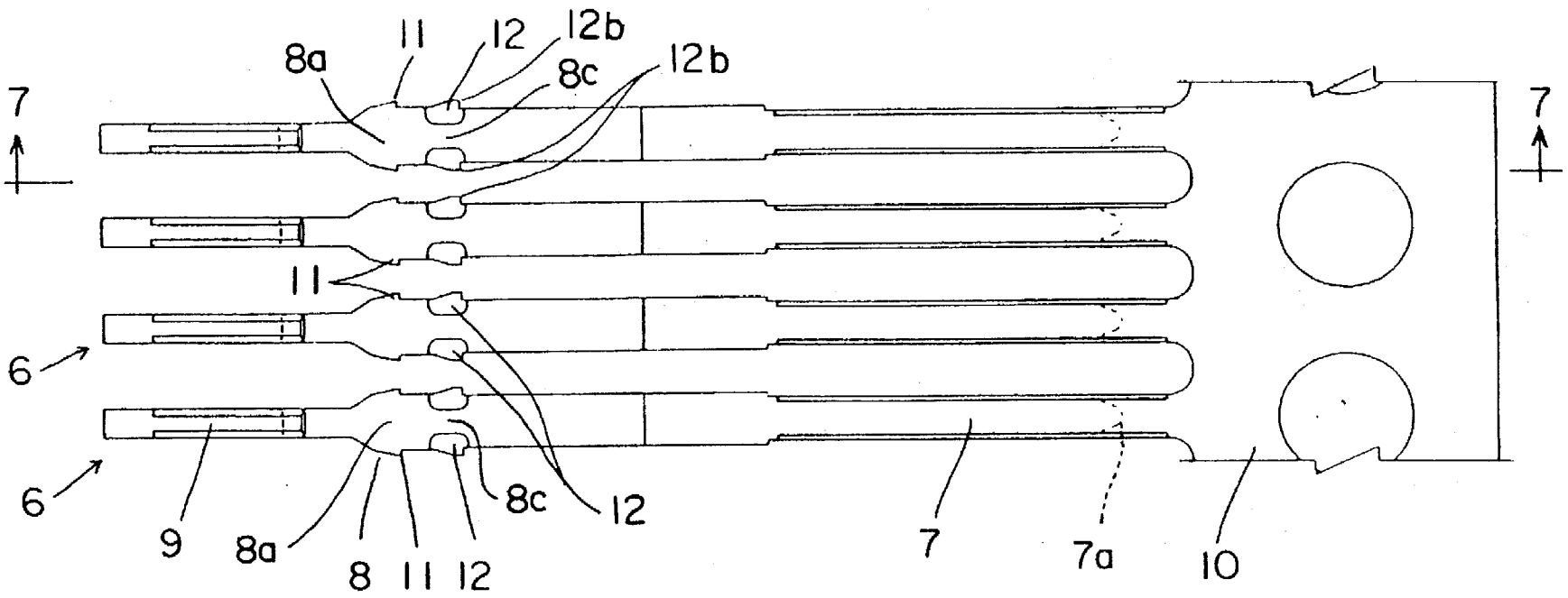
FIG. 6 is a plan view of a plurality of stamped and formed terminals still connected to a carrier strip during manufacture.
Figure 7:
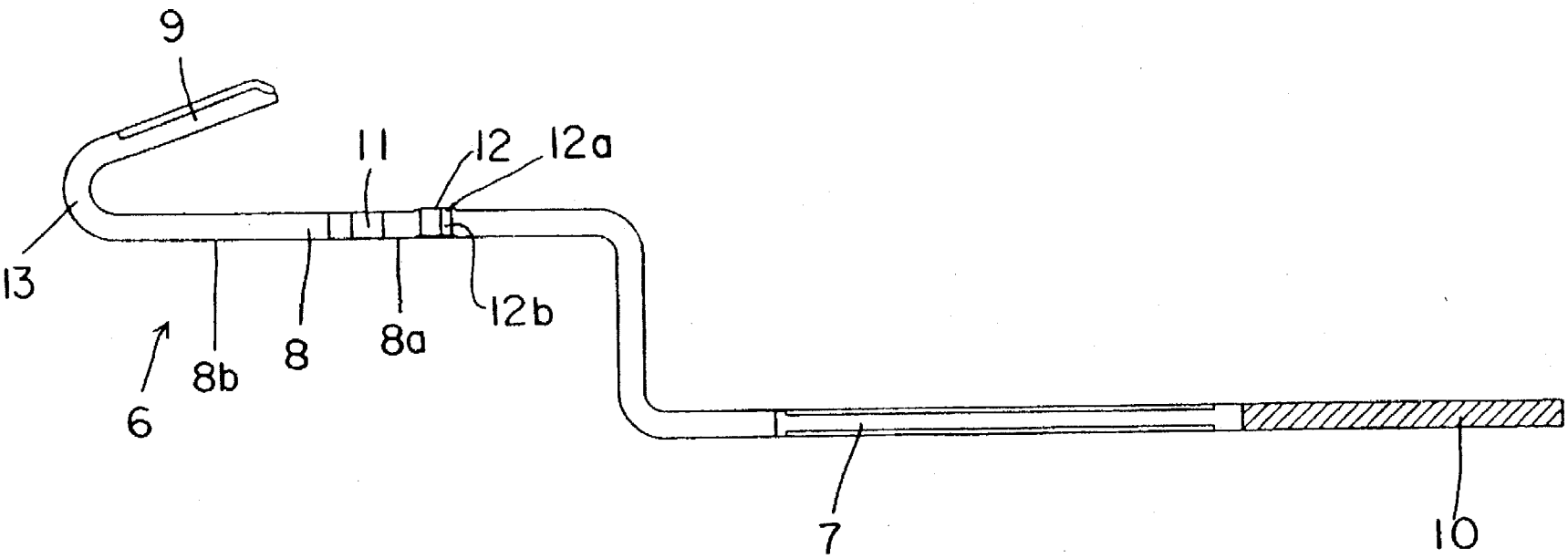
FIG. 7 is a section taken generally along line 7—7 of FIG. 6.

Referring next to FIGS. 6 and 7, each terminal 6 includes a terminating portion or tail 7 extending rearwardly of a generally planar body portion 8. A contact portion 9 extends forwardly of the body portion. The terminal is stamped and formed by known processes with terminating portion or tail 7 of each terminal still connected to a carrier strip 10. Upon installation of the terminals into connector housing 2, each individual terminal 6 is separated from carrier strip 10 by cutting along a broken line 7*a*.

Body portion 8 of each terminal 6 is generally planar or of a flat configuration and includes a retention section 8*a*. A pair of teeth 11 project outwardly from opposite edges of the body portion between retention section 8*a* and contact portion 9. As will be more clearly described below, a retention nib 12 is coined out of each edge of retention section 8*a* of body portion 8 to define a generally planar surface 12*a* offset from one side 8*c* of the body portion/ retention section. Contact portion 9 is formed as one leg of a U-shaped front end of the terminal, which is formed to also include a bend 13 between the contact portion and an extension 8*b* of the body portion. As best seen in FIG. 7, contact portion 9 is at an angle or oblique to body portion 8.

Front mating face 3 of connector housing 2 is adapted for receiving a flat cable, such as a flat flexible cable, or a flexible printed circuit board, having conductors for engaging contact portions 9 of terminals 6. Rear face 4 of housing 2 defines a terminal installation area which is communicated by terminal-receiving passages 5 with front mating face 3. Each terminal-receiving passage 5 includes a lower interior wall, generally designated 17*a*, and an upper interior wall, generally designated 17*b*. Lower interior wall 17*a* opposes contact portion 9 of the terminal to form a mouth or gap 19 for receiving the flat cable between contact portion 9 and lower interior wall 17*a*. The lower interior wall is generally parallel to exterior surfaces 18 of housing 2.

The upper interior wall 17*b* of each terminal-receiving passage 5 has a flat surface 20 opposing retention section 8*a* of planar body portion 8 of each respective terminal 6. Flat surface 20 is generally parallel to exterior surfaces 18 of housing 2.

The upper interior wall 17*b* of each passage 5 has a forwardly extending tapered surface 21 which is tapered in a direction away from body portion 8 of the terminal in the area of extension 8*b* of the body portion. This allows increased deflection of the contact end of the terminal while the terminal is being retained in the area of retention section 8*a*.

Figure 2:
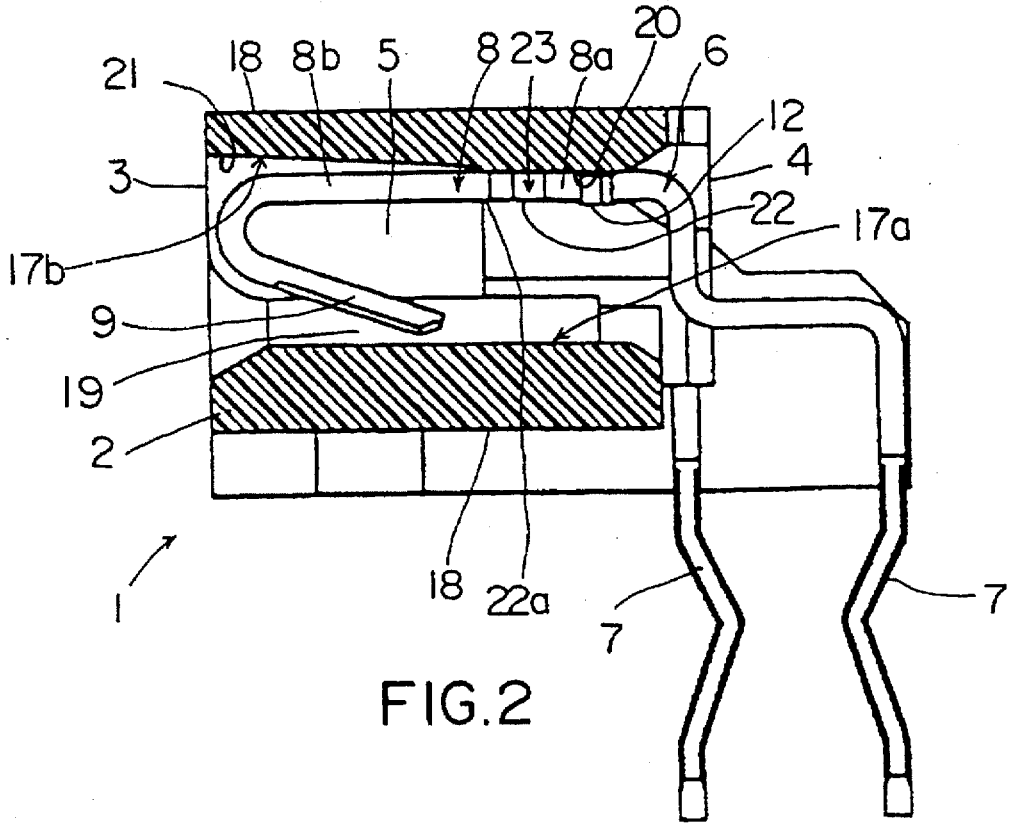
FIG. 2 is an enlarged section taken generally along line B—B of FIG. 3.
Figure 3:
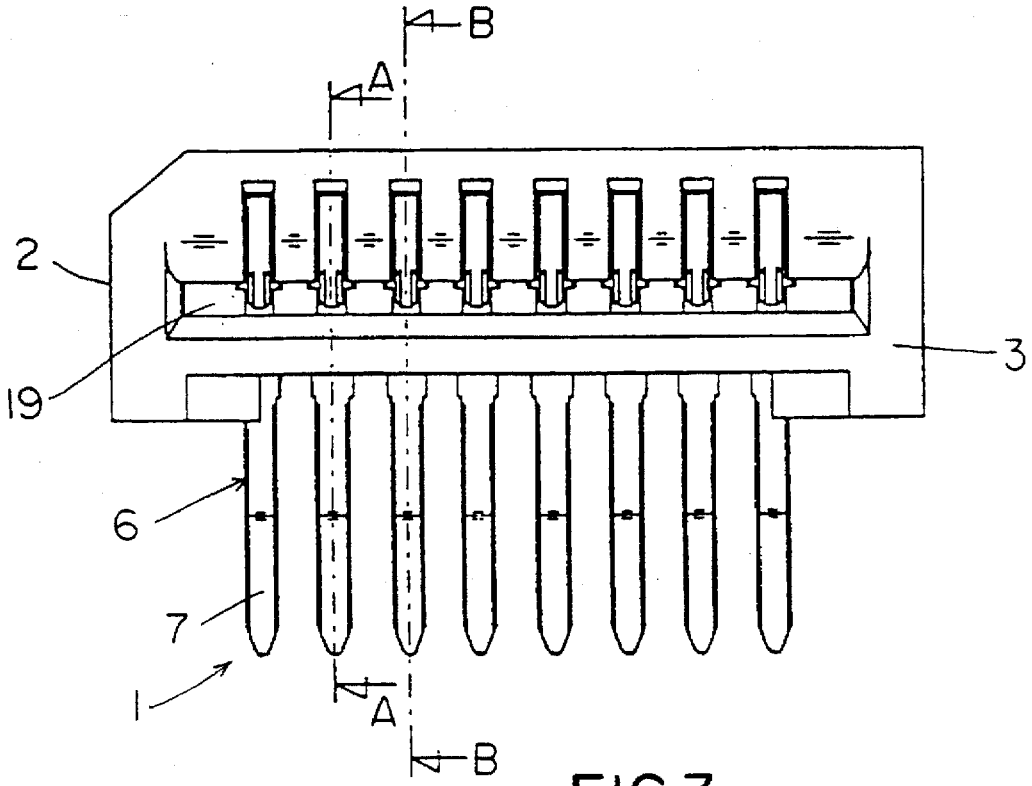
FIG. 3 is a bottom plan view of an electrical connector according to the present invention.
Figure 4:
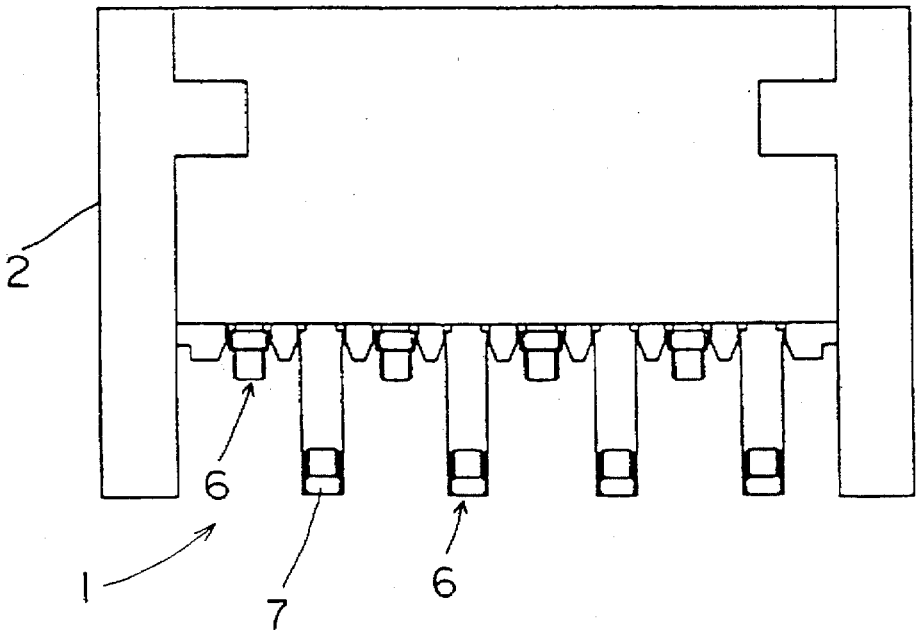
FIG. 4 is a top plan view of the connector.
Figure 5:
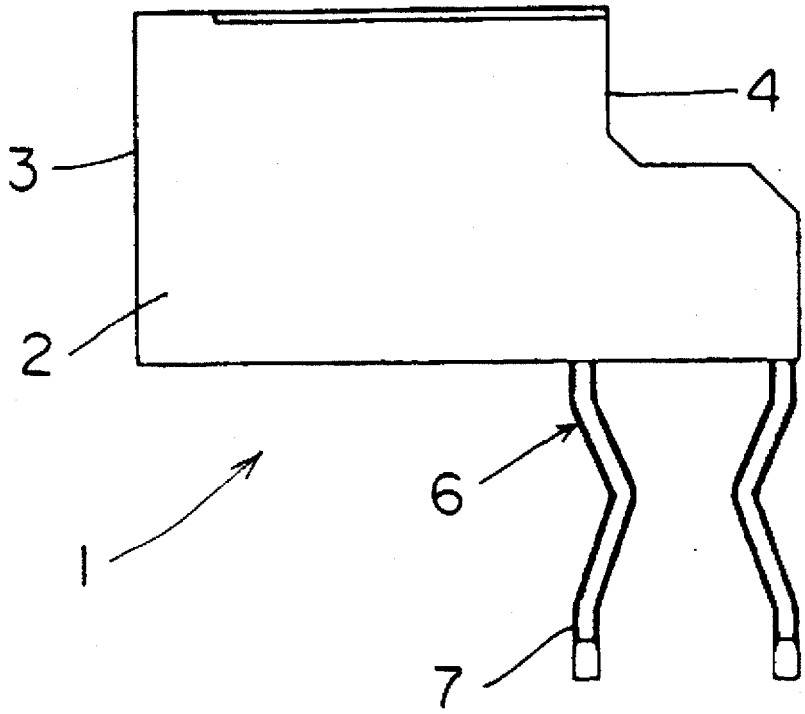
FIG. 5 is a side elevational view of the connector.
Figure 8:
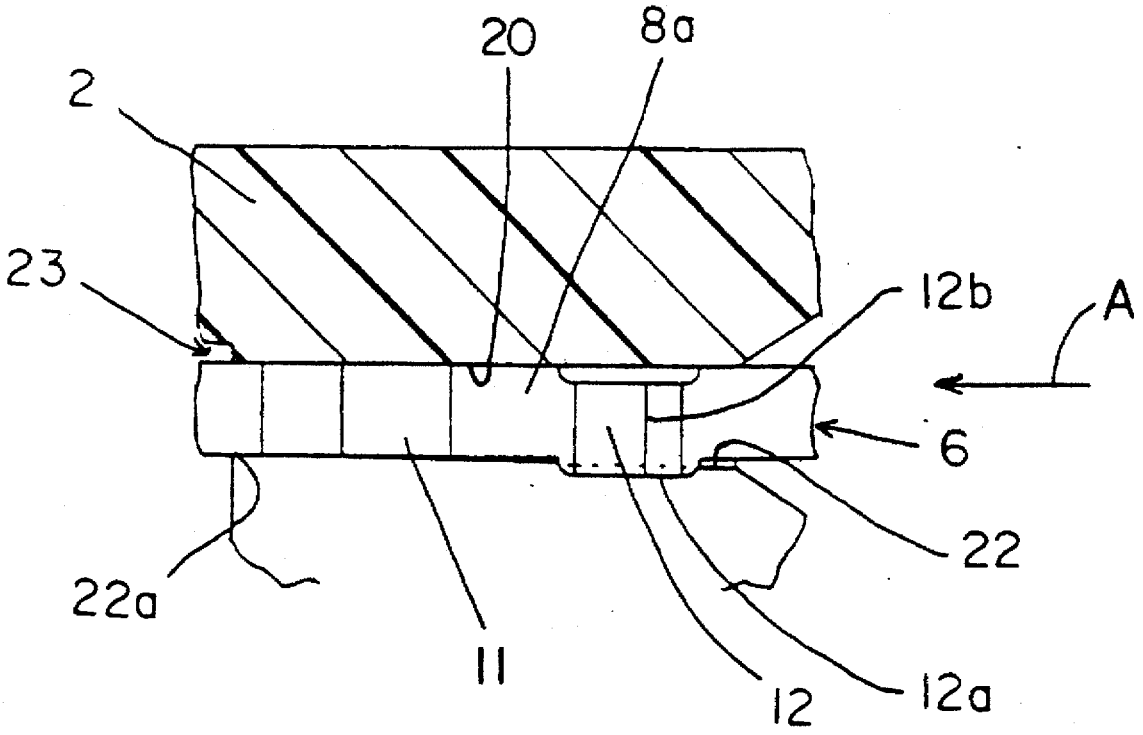
FIG. 8 is an enlarged, fragmented section through the terminal retention area of the connector.

Referring to FIG. 8 in conjunction with FIGS. 1 and 2, the retention section 8*a* of each terminal is inserted into opposing slots on opposite sides of each terminal-receiving passage 5. Each slot is defined on the one or top side by flat surface 20 of upper interior wall 17*b* and the opposite or lower side by a wall portion 22. In other words, the retention section is sandwiched between flat surface 20 and wall portions 22 at opposite side edges of the terminal upon insertion of the terminal into its passage 5. Contact portion 9 and the front end of the terminal can bypass these slots because, as clearly seen in FIG. 6, the front ends of the terminals are significantly narrower than retention section 8*a*.

As seen in FIG. 8, wall portion 22 of each slot on each opposite side of each passage 5 is tapered to widen the slot in the direction of the rear insertion end of the housing. FIG. 8 also shows how each coined retention nib 12 is formed with a generally planar surface 12*a* offset from the bottom side of retention section 8*a* and body portion 8.

Therefore, as terminal 6 is inserted into its respective passage 5 is the direction of arrow "A" (FIG. 8), the generally planar or flat surfaces 12*a* of coined retention nibs 12 engage tapered surfaces of wall portion 22 of the slots at opposite sides of the passage 5, while the opposite side of the retention section 8*a* and body portion 8 engage surface 20 at the opposite sides of the slots. In essence, the terminal, at coined retention nibs 12, becomes clamped by a press fit between flat surface 20 and tapered surfaces 22. In addition, as best seen in FIG. 6, coined retention nibs 12 are stamped with outwardly projecting teeth 12*b*. These teeth skive into the lateral side walls (not shown) of the slots at opposite sides of the respective terminal-receiving passage 5 between flat surface 20 and tapered surfaces 22. In addition, teeth 11 also skive into the side walls of the slots.

Still referring to FIG. 8, with surfaces 22 tapering forwardly of the passage, body portion 8 of the terminal is clamped between flat surface 20 and a front end 22*a* of wall portion 22. This total retention system substantially eliminates any play or movement whatsoever between the terminals and connector housing 2 within the terminal-receiving passages.

The flat cable is inserted into the mouth or gap 19 through front mating face 3 of housing 2 to interconnect the flat cable with a printed circuit board on which electrical connector 1 is mounted, with tails 7 coupled to circuit traces on the board. Upon insertion of the flat cable into gap 19, in addition to deflection of contact portion 9 of terminal 6 by the action of curved portion 13, extension 8*b* of body portion 8 may also deflect until it contacts tapered surface 21 of upper interior wall 17*b*. Therefore, the effective spring length of contact portion 9 is expanded. In addition, it becomes possible to reduce the insertion force required for inserting the flat cable. Still further, electrical connection between contact portion 9 and the respective conductor on the flat cable is effectively maintained. Lastly, since the terminal is not required to have a special configuration for increasing its effective spring length, fabrication of the terminal is efficient and inexpensive.

Finally, in fabricating terminals 6, retention nibs 12 are coined out of the side edges of retention section 8*a* of body portion 8 as seen in FIG. 6, with retention nibs 12 being laterally spaced to leave a planar section 8*c* of the body portion between the nibs. The side of this planar section opposite planar surfaces 12*a* of retention nibs 12 effectively engages flat surface 20 of the connector housing. Teeth 12*b* can be stamped from coined retention nibs 12 either simultaneously with the coining operation or subsequent thereto in order to define distinct sharp profiles for the teeth.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

I claim:

1. An electrical terminal, comprising:

an elongated planar body portion defining generally parallel opposite sides and opposite edges;

a contact portion extending forwardly of the body portion;

a terminating portion extending rearwardly of the body portion; and the body portion including a retention section having a retention nib coined out of each edge of the body portion and defining a generally planar surface offset from one side of the body portion and generally parallel thereto, the body portion adapted so that the planar surfaces of the retention nibs engage one side of a passage in an appropriate housing as the opposite side of the body portion engages the side of the passage opposite the one side.

2. The electrical terminal of claim 1 wherein said terminal is stamped and formed of sheet metal material.

3. The electrical terminal of claim 1 wherein each of said retention nibs includes a tooth projecting outwardly of the adjacent edge of the body portion for establishing an interference fit with a portion of said passage.

4. The electrical terminal of claim 1 wherein said body portion includes teeth projecting outwardly from the opposite edges thereof and spaced longitudinally of the retention section.

5. The electrical terminal of claim 4 wherein said teeth are located between the retention section and the contact portion.

6. The electrical terminal of claim 1 wherein said retention nibs are spaced laterally of the body portion to leave a planar section of the body portion between the nibs.

7. An electrical connector, comprising:

a dielectric housing;

a plurality of terminal-receiving passages in the housing, each passage including, in cross-section, generally parallel opposing sides and opposite ends; and a plurality of terminals received in the passages, each terminal including an elongated planar body portion defining generally parallel opposite sides and opposite edges, a contact portion extending forwardly of the body portion, a terminating portion extending rearwardly of the body portion, and the body portion including a retention section having a retention nib coined out of each edge of the body portion and defining a generally planar surface offset from one side of the body portion and generally parallel thereto, the body portion adapted so that the planar surfaces of the retention nibs engage one of the opposing sides of a respective one of said terminal-receiving passages and the opposite side of the body portion engages the side of the passage opposite the one side.

8. The electrical connector of claim 7 wherein said terminal is stamped and formed of sheet metal material.

9. The electrical connector of claim 7 wherein said retention nibs include teeth projecting outwardly from the edges of the body portion for establishing an interference fit with the opposite ends of the respective passage.

10. The electrical connector of claim 7 wherein said body portion includes teeth projecting outwardly from the opposite edges thereof and spaced longitudinally of the retention section.

11. The electrical connector of claim 10 wherein said teeth are located between the retention section and the contact portion.

12. The electrical connector of claim 7 wherein said retention nibs are spaced laterally of the body portion to leave a planar section of the body portion between the nibs.

13. The electrical connector of claim 7 wherein said generally parallel opposing sides of each terminal-receiving passage are relatively tapered toward each other in a terminal-insertion direction for establishing a press fit between the planar surfaces of the retention nibs and the opposite side of the body portion.

14. The electrical connector of claim 13 wherein each terminal-receiving passage includes a narrowed section between said tapered opposing sides for clamping opposite sides of the body portion forwardly of the retention section.

* * * * *